US010769995B2

(12) United States Patent
Min et al.

(10) Patent No.: US 10,769,995 B2
(45) Date of Patent: Sep. 8, 2020

(54) DISPLAY DEVICE AND PANEL COMPENSATION METHOD THEREOF

(71) Applicant: SILICON WORKS CO., LTD., Daejeon (KR)

(72) Inventors: Kyung Jik Min, Daejeon (KR); Won Kab Oh, Daejeon (KR); Su Hun Yang, Gwangmyeong-si (KR); Jeong Hie Choi, Cheongju-si (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/347,547

(22) PCT Filed: Nov. 1, 2017

(86) PCT No.: PCT/KR2017/012210

§ 371 (c)(1),
(2) Date: May 3, 2019

(87) PCT Pub. No.: WO2018/084551

PCT Pub. Date: May 11, 2018

(65) Prior Publication Data

US 2019/0251900 A1 Aug. 15, 2019

(30) Foreign Application Priority Data

Nov. 3, 2016 (KR) ..... 10-2016-0146060

(51) Int. Cl.
*G09G 3/3233* (2016.01)
*G09G 3/3258* (2016.01)
(Continued)

(52) U.S. Cl.
CPC ..... *G09G 3/3233* (2013.01); *G09G 3/20* (2013.01); *G09G 3/3258* (2013.01);
(Continued)

(58) Field of Classification Search
CPC ..... G09G 3/3233; G09G 3/20; G09G 3/3258; G09G 3/3283; G09G 3/3291; G09G 2310/027; G09G 2310/08
See application file for complete search history.

(56) References Cited

U.S. PATENT DOCUMENTS 9,858,862 B2 * 1/2018 Kwon ..... G09G 3/3258
2012/0032991 A1 * 2/2012 Cha ..... G09G 3/3208 345/690

(Continued)

FOREIGN PATENT DOCUMENTS

EP 3038088 A1 * 6/2016 ..... G09G 3/3233
KR 10-1188053 10/2012

(Continued)

OTHER PUBLICATIONS

International Search Report for International Application No. PCT/KR2017/012210, dated Mar. 8, 2018.

(Continued)

*Primary Examiner* — Michael Pervan
(74) *Attorney, Agent, or Firm* — Polsinelli PC

(57) ABSTRACT

Disclosed are a display device and a panel compensation method of the display device. The panel compensation method of the display device includes a step of allowing at least one line pixel of a display panel to be a current source that generates a pixel current with the same value, and a step of correcting a deviation between all current sensing paths of a source driver by using the pixel current with the same value and correcting a characteristic deviation between all pixels after correcting the deviation between the current sensing paths.

18 Claims, 4 Drawing Sheets

(51) Int. Cl.

| | |
|---|---|
| ***G09G 3/3291*** | (2016.01) |
| ***G09G 3/3283*** | (2016.01) |
| ***G09G 3/20*** | (2006.01) |

(52) U.S. Cl.
CPC ..... *G09G 3/3283* (2013.01); *G09G 3/3291* (2013.01); *G09G 2310/027* (2013.01); *G09G 2310/08* (2013.01)

(56) References Cited

U.S. PATENT DOCUMENTS

| | | | | |
|---|---|---|---|---|
| 2016/0189615 | A1* | 6/2016 | Kwon | G09G 3/3233 345/214 |
| 2018/0033374 | A1* | 2/2018 | Jeong | G09G 3/2088 |

FOREIGN PATENT DOCUMENTS

| | | |
|---|---|---|
| KR | 10-2014-0117742 | 10/2014 |
| KR | 10-2015-0079306 | 7/2015 |
| KR | 10-1549343 | 9/2015 |
| KR | 10-2016-0078629 | 7/2016 |

OTHER PUBLICATIONS

Written Opinion for International Application No. PCT/KR2017/012210 with English translation, dated Mar. 8, 2018.

* cited by examiner

DISPLAY DEVICE AND PANEL COMPENSATION METHOD THEREOF

BACKGROUND

1. Technical Field

The present disclosure relates to a display device, and more particularly, to a display device capable of accurately compensating for a characteristic deviation between pixels of a display panel and a panel compensation method thereof.

2. Related Art

In general, a display device includes a display panel in which pixels are arranged in a matrix form at points where data lines and gate lines intersect with each other, a data driving device that provides a source driving signal to the data lines, a gate driving device that provides a scan signal to the gate lines, and a timing controller that controls the data driving device and the gate driving device.

The data driving device includes a plurality of source drivers, and the source driver converts image data provided from the timing controller into the source driving signal and provides the source driving signal to the data lines of the display panel. The source driver is composed of one chip and may be composed of a plurality of chips in consideration of the size and resolution of the display panel.

The display panel may have a characteristic deviation between the pixels. Each source driver senses pixel information of the display panel, converts the sensed pixel information into digital data, and provides the digital data to the timing controller. The timing controller corrects the characteristic deviation between the pixels by using the digital data corresponding to the pixel information.

Each source driver includes an analog-to-digital converter (ADC) that converts the pixel information into the digital data. Also, since there may be a characteristic deviation between the ADCs of the respective source drivers, it is necessary to correct the characteristic deviation.

When a current sensing method is used, the display device of the related art corrects a characteristic deviation between respective source drivers through an external reference current source, and then corrects the pixel characteristics of the display panel.

In the display device of the related art described above, since an error may occur in a sensing value due to a difference between current paths provided with a reference current from the reference current source to the respective source drivers and a difference between current paths for sensing a pixel current between the pixels of the display panel, external compensation for a characteristic deviation between the pixels of the display panel may be inaccurate.

SUMMARY

Various embodiments are directed to a display device capable of accurately compensating for a characteristic deviation between pixels of a display panel and a driving method thereof.

In an embodiment, a panel compensation method of a display device includes: using at least one line pixel as a current source that generates a pixel current with a same value by correcting a characteristic deviation of the at least one line pixel of a display panel; and correcting a deviation between all current sensing paths of a source driver by using the pixel current with the same value provided from the at least one line pixel, and correcting a characteristic deviation between all pixels by using the corrected current sensing paths.

In an embodiment, a display device includes: a sensing circuit that performs at least one of first driving for sensing a reference voltage applied to a sensing line corresponding to at least one line pixel of a display panel, second driving for sensing a pixel voltage corresponding to first reference data applied to the at least one line pixel, third driving for sensing a pixel current with a same value applied to all sensing lines, and fourth driving for sensing a current of all pixels corresponding to second reference data applied to all the pixels; an analog-to-digital converter that converts sensing signals by the first driving to the fourth driving into first to fourth digital data; and a compensation circuit that controls the reference voltage to be applied to the sensing line corresponding to the at least one line pixel, controls the first reference data to be applied to the at least one line pixel, controls the pixel current with the same value to be applied to all the sensing lines, controls the second reference data to be applied to all the pixels, and corrects characteristics of the sensing circuit, a characteristic deviation of the at least one line pixel, a deviation between current sensing paths of the sensing circuit, and a characteristic deviation between all the pixels by using the first to fourth digital data received from the analog-to-digital converter.

In an embodiment, a display device includes: a panel compensation circuit, wherein the panel compensation circuit corrects characteristics of a source driver by applying a reference voltage to a sensing line corresponding to at least one line pixel of a display panel, corrects a characteristic deviation of the at least one line pixel by applying first reference data, in which the characteristics of the source driver have been corrected, to the at least one line pixel, corrects a deviation between current sensing paths of the source driver by applying a pixel current with a same value the at least one line pixel to all the sensing lines, and corrects a characteristic deviation between all pixels by applying second reference data, in which the deviation between the current sensing paths of the source driver has been corrected, to all the pixels.

According to the present invention, since at least one line pixel of the display panel is allowed to be a current source that generates the pixel current with the same value, there is no deviation of a current path through which a reference current is provided, so that it is possible to accurately correct a deviation between the current sensing paths.

Furthermore, according to the present invention, the reference voltage is applied to at least one sensing line in common through common routing in order to correct the characteristics of the source driver, so that it is possible to reduce a chip area of the source driver.

Furthermore, the present invention corrects the characteristics of the source driver, a characteristic deviation of at least one line pixel, a deviation between the current sensing paths of the source driver, and a characteristic deviation between all pixels by a combination of a voltage sensing method and a current sensing method, so that it is possible to improve correction stability and to improve a correction speed as compared with panel sensing using only the voltage sensing method.

Furthermore, according to the present invention, it is possible to accurately compensate for a characteristic deviation between the pixels of the display panel, so that it is possible to improve image quality.

DETAILED DESCRIPTION

Figure 1:
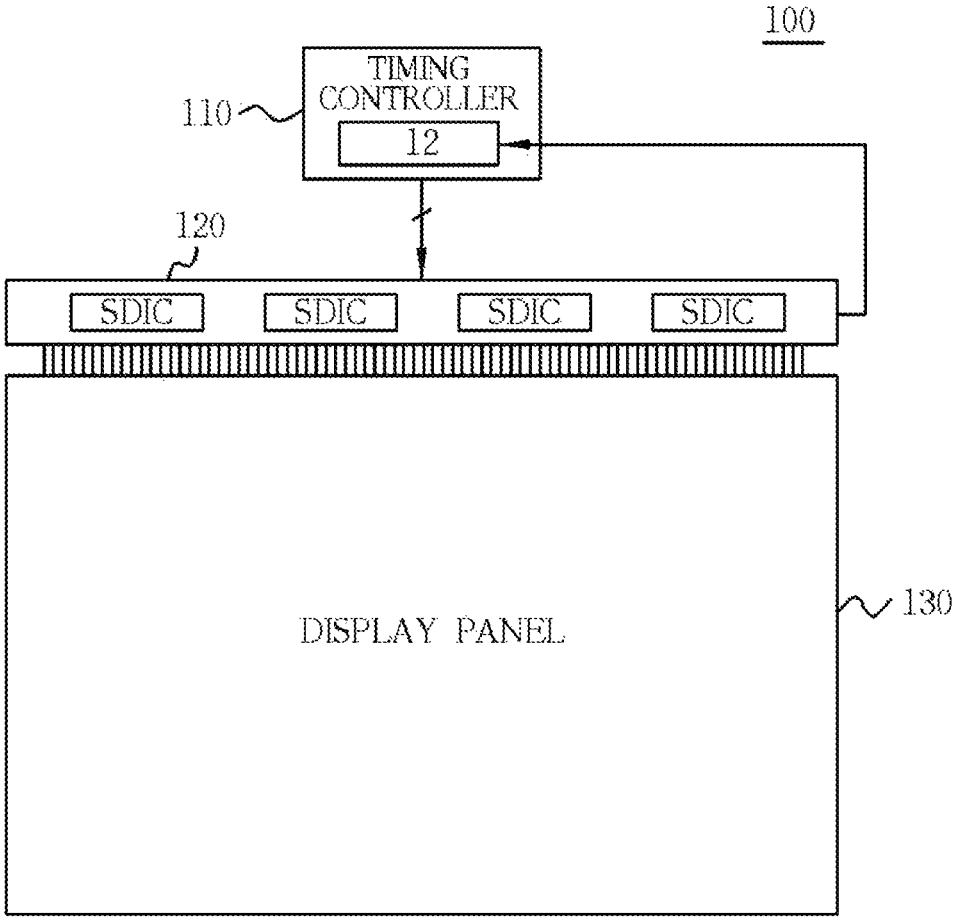
FIG. 1 is a diagram illustrating a display device according to an embodiment of the present invention.

Hereafter, embodiments of the present invention will be described in detail with reference to the accompanying drawings. The terms used in this specification and claims are not interpreted as being limited to typical or dictionary definitions, but should be interpreted as meanings and concepts which coincide with the technical idea of the present invention.

Embodiments described in this specification and configurations illustrated in the drawings are preferred embodiments of the present invention, and do not represent the entire technical idea of the present invention. Thus, various equivalents and modifications capable of replacing the embodiments and configurations may be provided at the time of filling the present application.

FIG. 1 is a diagram illustrating a display device according to an embodiment of the present invention.

Referring to FIG. 1, a display device 100 according to an embodiment of the present invention includes a timing controller 110, a data driving device 120, a gate driving device (not illustrated), and a display panel 130.

The timing controller 110 provides image data to the data driving device 120, and controls the gate driving device and the data driving device 120 such that a source driving signal corresponding to the image data is supplied to the display panel 130.

The timing controller 110 receives digital data corresponding to at least one of pixel information and a reference voltage from the data driving device 120, and corrects the characteristics of source drivers SDIC, a characteristic deviation of at least one line pixel, a deviation between current sensing paths, and a characteristic deviation between all pixels of the display panel 130, by using the digital data.

The timing controller 110 may include a compensation unit 12 that performs the aforementioned correction and compensates for the image data. The compensation unit 12 according to the embodiment of FIG. 1 is provided in the timing controller 110; however, the compensation unit 12 may be provided outside the timing controller 110 or provided in the data driving device 120.

The compensation unit 12 receives the digital data corresponding to at least one of the pixel information and the reference voltage from the source drivers SDIC, calculates the characteristics of the source drivers SDIC, the characteristic deviation of the at least one line pixel, the deviation between the current sensing paths, and the characteristic deviation between all the pixels, generates compensation data corresponding to the deviations, and compensates for the image data.

The data driving device 120 converts the image data provided from the timing controller 110 into an analog source driving signal, and supplies the source driving signal to data lines of the display panel 130. The data driving device 120 includes a plurality of source drivers SDIC, wherein one source driver may be composed of one integrated circuit (IC) and the number of source drivers may be determined in consideration of the size and resolution of the display panel 130.

Each of the source drivers SDIC may include a shift register, a latch, a digital-to-analog converter, an output buffer and the like in order to supply the display panel 130 with the source driving signal corresponding to the image data. Furthermore, each of the source drivers SDIC may include a sensing circuit and an analog-to-digital converter in order to correct a characteristic deviation between the pixels of the display panel 130.

As the display panel 130, a liquid crystal panel, an organic light emitting diode (OLED) panel and the like may be used. Each pixel of the display panel 130 has electrical characteristics. There are a voltage sensing method and a current sensing method as a method for sensing the characteristics of the display panel.

The voltage sensing method is a method for sensing a voltage, which is somewhat slow in speed, but has high stability as a voltage is measured in a voltage stabilization section and is low an influence of a parasitic component unlike the current sensing method. Furthermore, the voltage sensing method can reduce a chip size because common routing is possible in order to correct the characteristics of the source driver.

The current sensing method is a method for directly measuring a current that defines the characteristics of a pixel, and compensation with fast time and accuracy is possible.

However, since the current sensing method needs to provide the same reference current to sensing lines in order to correct the characteristics of the source drivers SDIC, inaccuracy may occur due to a deviation in independent routings that provides the reference current. The display device 100 of the present invention compensates for the pixel characteristics of the display panel by a combination of the voltage sensing method and the current sensing method.

Firstly, the display device 100 corrects the characteristics of the source drivers by using the voltage sensing method, and corrects a characteristic deviation of at least one line pixel of the display panel 130, thereby allowing the at least one line pixel to be a current source that generates a pixel current with the same value. The at least one line pixel may be configured using effective line pixels of the display panel or separate dummy line pixels.

Next, the display device 100 supplies a pixel current with the same value provided from at least one line pixel to all the sensing lines by using the current sensing method to correct a deviation between current sensing paths of the source driver, and supplies the reference data to all the pixels to correct a deviation between the pixels of the display panel 130.

The compensation of the pixels characteristics of the display panel through the aforementioned combination of the voltage sensing method and the current sensing method will be described in detail below.

Figure 2:
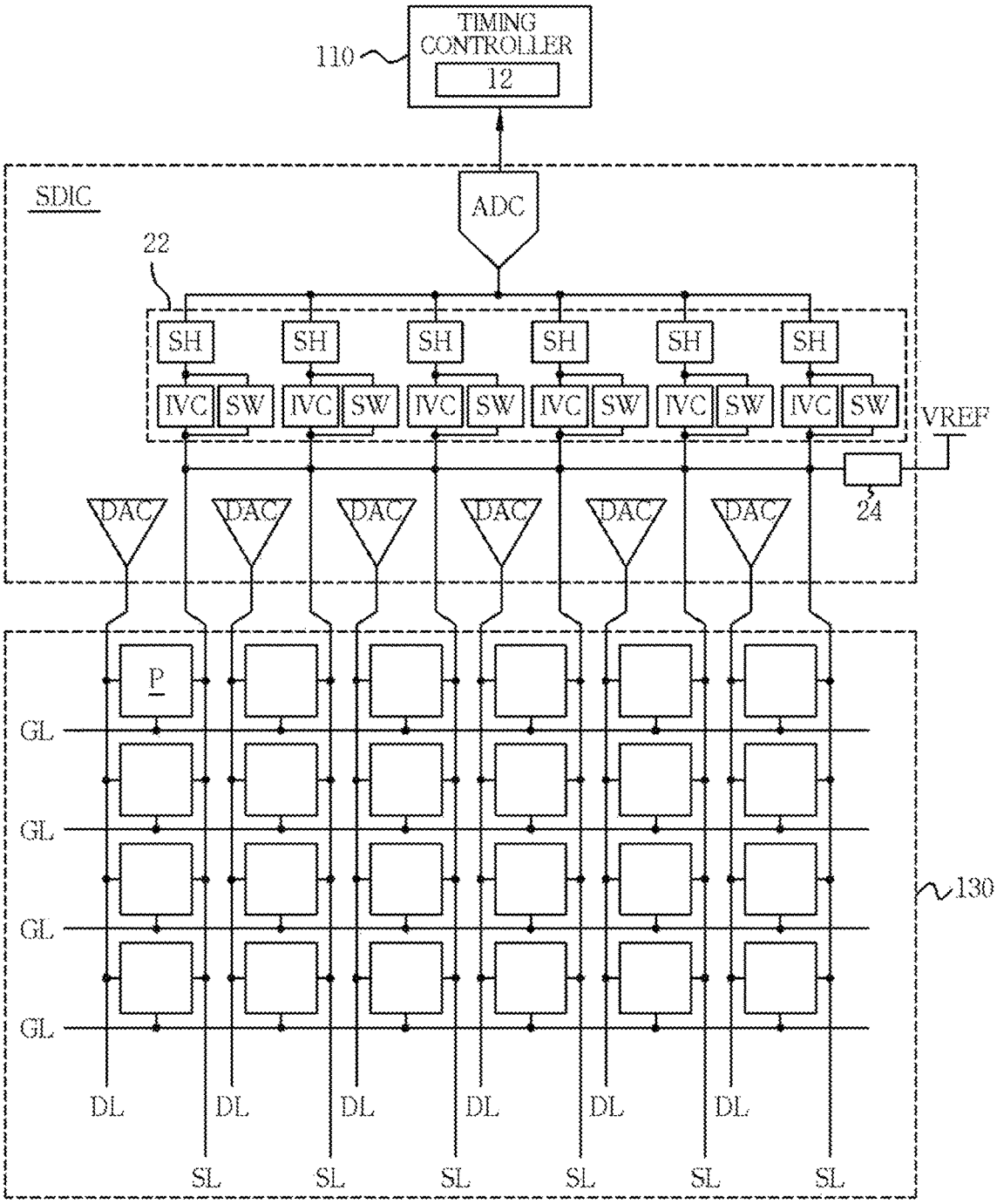
FIG. 2 is a diagram illustrating a pixel array of a display panel illustrated in FIG. 1 and a source driver for sensing pixel information.

FIG. 2 is a diagram illustrating a pixel array of the display panel illustrated in FIG. 1 and the source driver for sensing pixel information.

Referring to FIG. 2, in the display panel 130, data lines DL are arranged in one direction, gate lines GL are arranged in a direction intersecting with the data lines DL, and pixels P are arranged at intersection points in a matrix form.

Each of the pixels P includes a driving circuit and a light emitting element and outputs a signal corresponding to pixel information through a sensing line SL. Each of the pixels P may have unique electrical characteristics and there may be a characteristic deviation between the pixels P. Furthermore, the characteristics of the pixels P may be changed according to an increase in the driving time of the display panel 130 and a change in temperature.

The characteristics of the pixels may include a threshold voltage ($V_{th}$) of the driving circuit, mobility and the like. Each of the pixels P may operate with normal driving for implementing an image and sensing driving for sensing pixel information, and the sensing driving may be performed for a predetermined time prior to the normal driving or performed in a vertical blank period during the normal driving or a separate compensation operation period.

The source driver SDIC may include a digital-to-analog converter DAC in order to supply the display panel 130 with a source driving signal corresponding to image data, and may include a sensing circuit 22 that senses pixel information from the display panel 130 in order to correct a characteristic deviation between the pixels P of the display panel 130 and an analog-to-digital converter ADC that converts the pixel information into digital data.

The sensing circuit 22 may include a current-to-voltage converter IVC, a sample and hold circuit SH, and a switch SW for each channel corresponding to each sensing line SL.

The current-to-voltage converter IVC converts a signal (a current) of the sensing line SL into a voltage, and the sample and hold circuit SH samples and holds the voltage converted by the current-to-voltage converter IVC and outputs the held voltage to the analog-to-digital converter ADC according to a preset order.

The switch SW is turned off when the sensing circuit 22 operates in the current sensing method and is turned on when the sensing circuit 22 operates in the voltage sensing method. When the switch SW is turned on, a signal (a voltage) of the sensing line SL is directly transferred to the sample and hold circuit SH.

The source driver SDIC may further include a reference voltage providing unit 24 and a switch circuit (not illustrated). The reference voltage providing unit 24 provides a reference voltage VREF to at least one sensing line SL through common routing, and the switch circuit transfers the reference voltage provided from the reference voltage providing unit 24 to the sensing lines SL connected in the common routing or blocks the transfer of the reference voltage.

The reference voltage providing unit 24 supplies the reference voltage VREF to at least one sensing line SL of the display panel 130. Such a reference voltage providing unit 24 may be activated at a time in which the characteristics of the analog-to-digital converter ADC of the source driver are corrected by using the voltage sensing method. The reference voltage VREF is supplied from the outside of the source driver SDIC and may be defined as an arbitrary common voltage having a predetermined level.

The switch circuit may perform an operation of transferring the reference voltage VREF provided from the reference voltage providing unit 24 to at least one sensing line SL or blocking the transfer of the reference voltage VREF.

The analog-to-digital converter ADC converts a voltage output from the sample and hold circuit SH of the sensing circuit 22 into digital data, and provides the digital data to the compensation unit 12 of the timing controller 110.

The compensation unit 12 of the timing controller 110 receives the digital data from the analog-to-digital converter ADC of the source driver SDIC, generates compensation data corresponding to the characteristics of the source drivers SDIC, a characteristic deviation between the pixels of the display panel 130, and a deviation of the current sensing path by using the digital data, and compensates for image data by using the compensation data.

Figure 3:
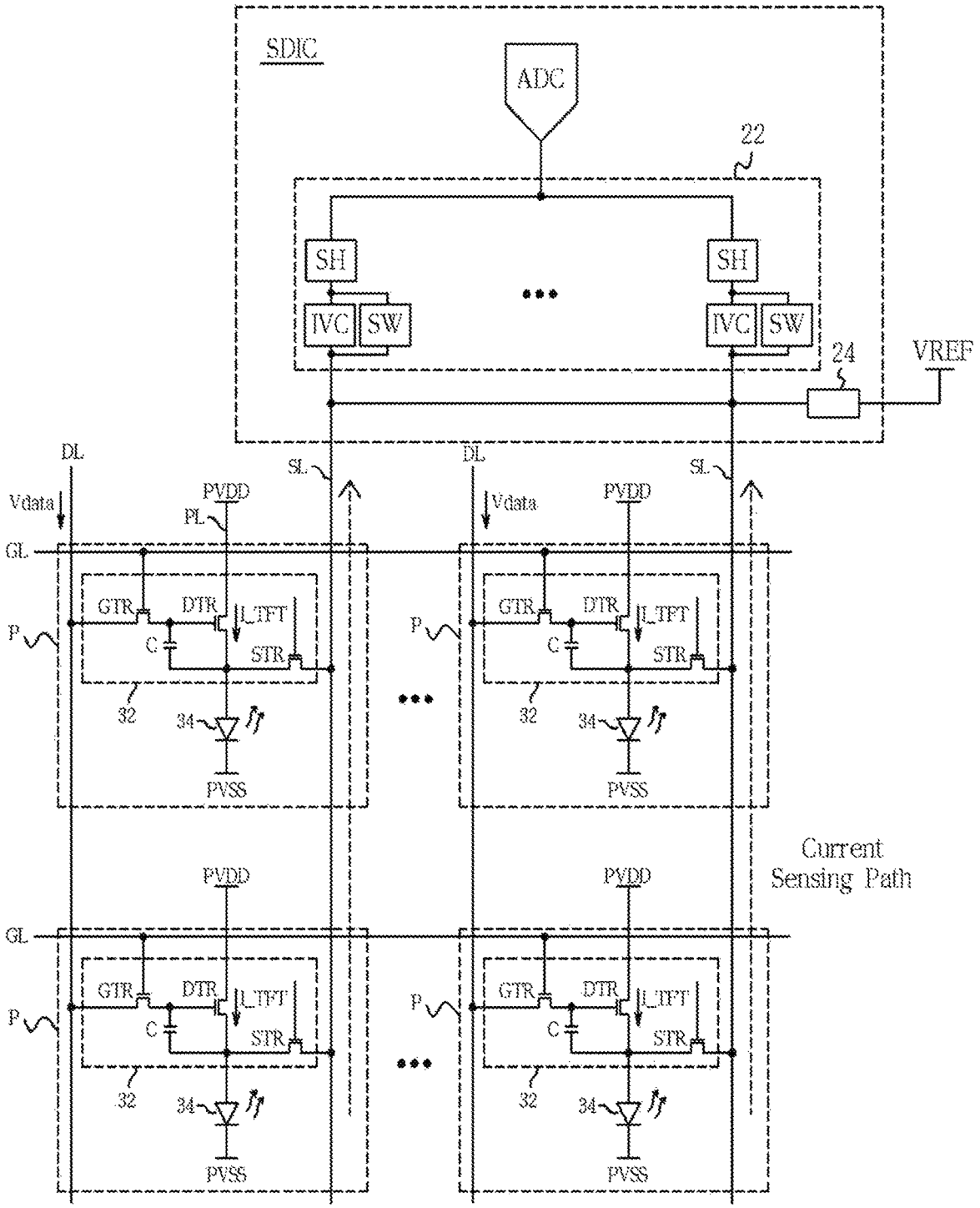
FIG. 3 is a circuit diagram for explaining a pixel structure illustrated in FIG. 2 and an operation of the source driver.

FIG. 3 is a circuit diagram for explaining the pixel structure illustrated in FIG. 2 and an operation of the source driver.

Referring to FIG. 3, each of the pixels P includes a driving circuit 32 and a light emitting element 34.

The driving circuit 32 includes a driving transistor DTR for driving the light emitting element 34, a gate transistor GTR for applying a source driving signal $V_{data}$ of the data line DL to a gate of the driving transistor DTR when a corresponding row is selected by a scan signal applied to the gate line GL, and a capacitor C for holding the source driving signal $V_{data}$ for a predetermined time.

The driving circuit 32 includes a sensing transistor STR for transferring pixel information to the sensing circuit 22 of the source driver SDIC through the sensing line SL when a specific pixel is selected by a sensing control signal. The reference numeral PL of FIG. 3 indicates a power line.

The driving transistor DTR of each pixel P has unique characteristics such as a threshold voltage ($V_{th}$) and mobility. Since such a driving transistor DTR is degraded as the driving time becomes longer, the unique characteristics such as a threshold voltage and mobility are changed, so that a characteristic deviation between the pixels may be increased.

The present invention is directed to improve image quality by accurately correcting a characteristic deviation between the pixels P. To this end, the present invention allows at least one line pixel to be a current source that outputs a pixel current with the same value by using the voltage sensing method, and corrects a deviation between the current sensing paths of the analog-to-digital converter ADC by using the current sensing method and corrects a characteristic deviation between all the pixels.

The process of allowing at least one line pixel to be a current source that outputs a pixel current with the same value by using the voltage sensing method will be described as follows.

Firstly, the reference voltage providing unit 24 provides at least one sensing line SL with the reference voltage VREF applied from an exterior.

The sensing circuit 22 senses the reference voltage VREF and provides the sensed reference voltage VREF to the analog-to-digital converter ADC. Herein, the switch SW of the sensing circuit 22 is turned on to directly transfer the reference voltage VREF to the sample and hold circuit SH.

The analog-to-digital converter ADC converts the output voltage of the sensing circuit 22 into digital data, and provides the digital data to the compensation unit 12 of the timing controller 110.

The compensation unit 12 corrects the characteristics of the analog-to-digital converter ADC by using the digital data corresponding to the reference voltage VREF. The characteristics of the analog-to-digital converter ADC may include an offset, a gain and the like.

The compensation unit 12 may correct the characteristics of the analog-to-digital converter ADC of each source driver SDIC to a preset reference value, so that a characteristic deviation between the source drivers SDIC may also be corrected.

Next, the timing controller 110 provides the source driver SDIC with the reference data in which the characteristics of the source driver SDIC have been corrected, and the source driver SDIC applies a source driving signal corresponding to the compensated reference data to at least one line pixel P of the display panel 130.

The sensing circuit 22 senses a pixel voltage corresponding to the at least one line pixel P to which the source driving signal is applied. Herein, the switch SW of the sensing circuit 22 is turned on to directly transfer the pixel voltage to the sample and hold circuit SH.

The analog-to-digital converter ADC converts the voltage output from the sensing circuit 22 into digital data, and provides the digital data to the compensation unit 12 of the timing controller 110.

The compensation unit 12 corrects a characteristic deviation of at least one line pixel by using the digital data corresponding to the pixel voltage. Through the aforementioned process, the at least one line pixel may serve as a current source that generates a pixel current with the same value.

Next, the process of correcting a deviation between the current sensing paths of the analog-to-digital converter ADC by using the current sensing method and correcting a characteristic deviation between all the pixels will be described as follows.

The sensing circuit 22 senses a pixel current ITFT with the same value of all sensing lines, which is applied from at least one line pixel, converts the sensed pixel current ITFT into a voltage, and provides the voltage to the analog-to-digital converter ADC. Herein, the switch SW of the sensing circuit 22 is turned off, so that the pixel current ITFT is converted into a voltage through the current-to-voltage converter IVC.

The analog-to-digital converter ADC converts the output voltage of the sensing circuit 22 into digital data, and provides the digital data to the compensation unit 12 of the timing controller 110.

The compensation unit 12 corrects a deviation between all the current sensing paths of the source driver by using the digital data corresponding to the pixel current ITFT.

Next, the timing controller 110 provides the source driver SDIC with the reference data in which the deviation between the current sensing paths have been corrected, and the source driver SDIC applies a source driving signal corresponding to the compensated reference data to all the pixels of the display panel 130.

The sensing circuit 22 senses the pixel current ITFT corresponding to all the pixels, converts the sensed pixel current ITFT into a voltage, and provides the voltage to the analog-to-digital converter ADC. Herein, the switch SW of the sensing circuit 22 is turned off, so that the pixel current ITFT is converted into a voltage through the current-to-voltage converter IVC.

The analog-to-digital converter ADC converts the output voltage of the sensing circuit 22 into digital data, and provides the digital data to the compensation unit 12 of the timing controller 110.

The compensation unit 12 corrects a characteristic deviation between all the pixels by using the digital data corresponding to the reference data applied to all the pixels. Through the aforementioned process, compensation data corresponding to the characteristic deviation between all the pixels can be generated and compensate for image data.

Figure 4:
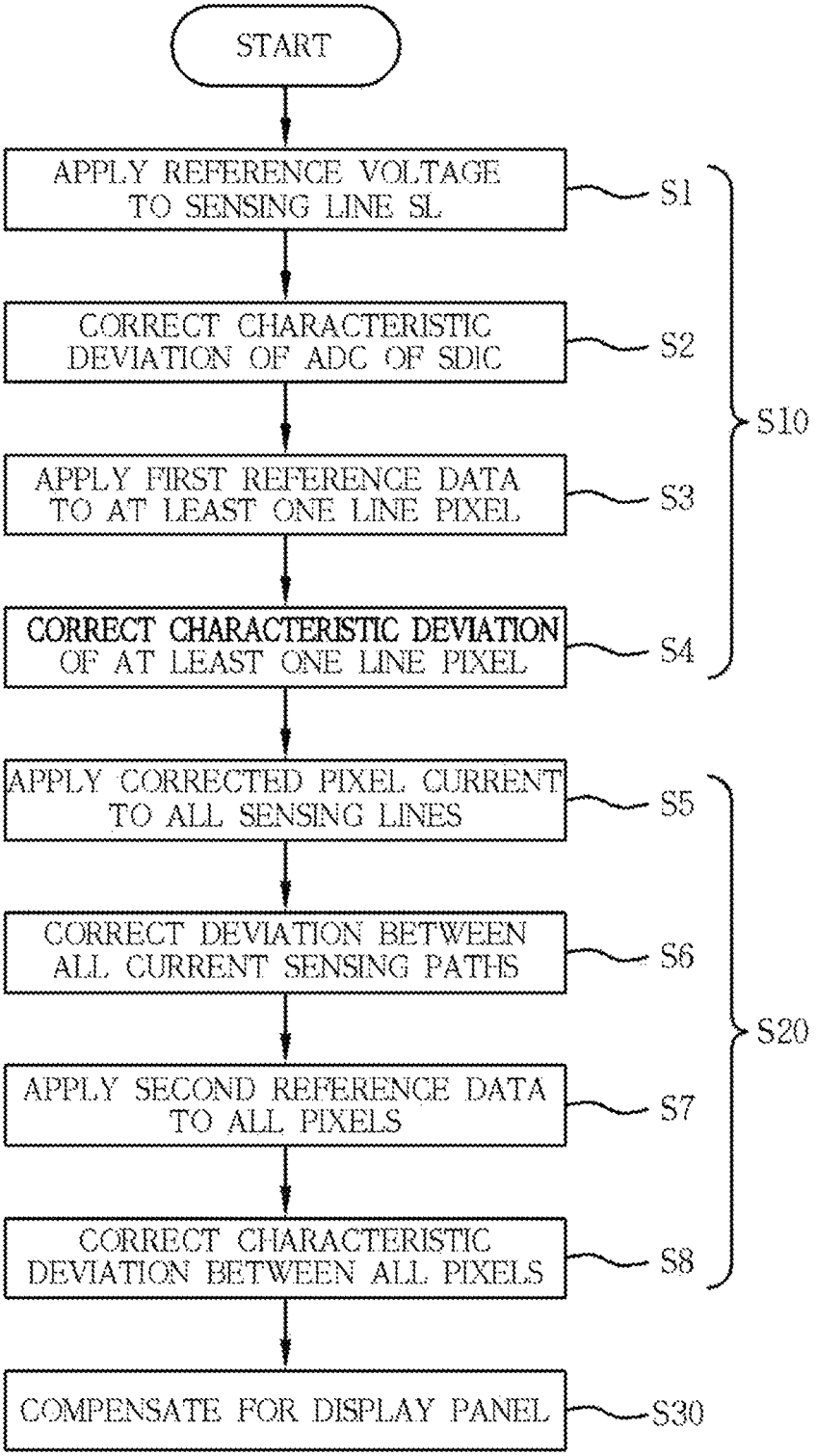
FIG. 4 is a flowchart for explaining a panel compensation method of the display device according to an embodiment of the present invention.

FIG. 4 is a flowchart for explaining a panel compensation method of the display device according to an embodiment of the present invention.

Referring to FIG. 4, the display device 100 corrects the characteristics of the source driver and the characteristic deviation of at least one line pixel of the display panel, thereby allowing the at least one line pixel to be a current source that generates a pixel current with the same value (S10).

Then, the display device 100 corrects a deviation between the current sensing paths of the source driver by using a pixel current with the same value provided from the at least one line pixel, and corrects a characteristic deviation between all the pixels by applying the reference data to all the pixels (S20).

The process S10 of allowing the at least one line pixel of the display panel 130 to be a current source that generates a pixel current with the same value will be described as follows.

Firstly, the display device 100 applies the reference voltage VREF to a sensing line corresponding to the at least one line pixel of the display panel 130 (S1), and receives digital data corresponding to the reference voltage VREF from the source driver SDIC and corrects the characteristics of the source driver by using the digital data (S2).

Next, the display device 100 applies the reference data, in which the characteristics of the source driver have been corrected, to the at least one line pixel (S3), and receives digital data corresponding to a pixel voltage of the at least one line pixel from the source driver SDIC and corrects the characteristic deviation of at least one line pixel by using the digital data (S4).

Hereinafter, the process S20 of correcting the characteristic deviation between the pixels of the display panel 130 will be described as follows.

Firstly, the display device 100 applies a pixel current with the same value, in which the characteristic deviation of at least one line pixel has been corrected, to all the sensing lines (S5), and receives digital data corresponding to pixel currents of all the sensing lines from the source driver SDIC and corrects a deviation between the current sensing paths of the source driver SDIC by using the digital data (S6).

Next, the display device 100 applies the reference data, in which the deviation between the current sensing paths of the source driver SDIC has been corrected, to all the pixels (S7), and receives digital data corresponding to pixel currents of all the pixels from the source driver SDIC and corrects a characteristic deviation between all the pixels by using the digital data (S8).

Then, the display device 100 generates compensation data corresponding to the characteristics of the display panel, and compensates for image data using the compensation data (S30).

Furthermore, the display device 100 of the present invention may include a panel compensation circuit that performs the aforementioned algorithm, and the panel compensation circuit may be included in at least one of the timing controller 110 and the source driver SDIC.

Furthermore, the display device 100 of the present invention exemplifies that the characteristic deviation of the analog-to-digital converter ADC between the source drivers is corrected by applying the reference voltage, which is provided from an exterior, to a sensing line corresponding to at least one line pixel; however, each source driver may be configured to self-correct the characteristics of the analog-to-digital converter ADC. For example, the source driver may be configured to self-correct the characteristics of the analog-to-digital converter ADC by applying an internal reference signal to a sensing line corresponding to at least one line pixel.

According to the present invention, since at least one line pixel of the display panel is allowed to be a current source that generates a pixel current with the same value, there is no deviation of a current path through which the reference current is provided, so that it is possible to accurately correct a deviation between the current sensing paths.

Furthermore, according to the present invention, the reference voltage is applied to at least one sensing line through common routing, so that it is possible to reduce a chip area of the source driver.

Furthermore, the present invention corrects the characteristics of the source driver, a characteristic deviation of at least one line pixel, a deviation between the current sensing paths of the source driver, and a characteristic deviation between all pixels by a combination of the voltage sensing method and the current sensing method, so that it is possible to improve correction stability and to improve a correction speed as compared with panel sensing using only the voltage sensing method.

Furthermore, according to the present invention, it is possible to accurately compensate for a characteristic deviation between the pixels of the display panel, so that it is possible to improve image quality.

What is claimed is:

1. A panel compensation method of a display device, comprising the steps of:

(a) using at least one line pixel as a current source that generates a pixel current with a same value by correcting a characteristic deviation of the at least one line pixel of a display panel; and (b) correcting a deviation between current sensing paths of a source driver by using the pixel current with the same value provided from the at least one line pixel, and correcting a characteristic deviation between pixels by using the corrected current sensing paths.

2. The panel compensation method of the display device of claim 1, wherein the step (a) comprises the steps of:

correcting characteristics of the source driver; and correcting the characteristic deviation of the at least one line pixel by applying first reference data to the at least one line pixel.

3. The panel compensation method of the display device of claim 2, wherein, in the step of correcting the characteristics of the source driver, the characteristics of the source driver are corrected by applying a reference voltage to a sensing line corresponding to the at least one line pixel.

4. The panel compensation method of the display device of claim 3, wherein, in the step of correcting the characteristics of the source driver, the source driver self-corrects characteristics of an analog-to-digital converter by using first digital data corresponding to the reference voltage.

5. The panel compensation method of the display device of claim 2, wherein the first reference data is data in which the characteristics of the source driver have been corrected and has a same level.

6. The panel compensation method of the display device of claim 1, wherein the step (a) comprises the steps of:

applying a reference voltage to a sensing line corresponding to the at least one line pixel;

sensing a voltage of the sensing line to which the reference voltage is applied;

correcting the characteristics of the source driver by using first digital data corresponding to the reference voltage;

applying first reference data, in which the characteristics of the source driver have been corrected, to the at least one line pixel;

sensing a voltage of to the at least one line pixel; and correcting the characteristic deviation of the at least one line pixel by using second digital data corresponding to the voltage of to the at least one line pixel.

7. The panel compensation method of the display device of claim 1, wherein the step (b) comprises the steps of:

correcting the deviation between the current sensing paths of the source driver by applying the pixel current with the same value, which is provided from the at least one line pixel, to sensing lines; and correcting the characteristic deviation between the pixels by applying second reference data to the pixels.

8. The panel compensation method of the display device of claim 7, wherein the second reference data is data in which the deviation between the current sensing paths of the source driver has been corrected and has a same level.

9. The panel compensation method of the display device of claim 1, wherein the step (b) comprises the steps of:

applying the pixel current with the same value, which is provided from the at least one line pixel, to sensing lines;

sensing the pixel current applied to the sensing lines;

correcting the deviation between the current sensing paths by using third digital data corresponding to the pixel current;

applying second reference data, in which the deviation between the current sensing paths has been corrected, to the pixels;

sensing a current of the pixels; and correcting the deviation between the current sensing paths by using fourth digital data corresponding to the current of the pixels.

10. A display device comprising:

a sensing circuit that performs at least one of first driving for sensing a voltage of a sensing line corresponding to at least one line pixel of a display panel and to which a reference voltage is applied, second driving for sensing a pixel voltage corresponding to first reference data applied to the at least one line pixel, third driving for sensing a pixel current with a same value applied to sensing lines, and fourth driving for sensing a current of pixels corresponding to second reference data applied to the pixels;

an analog-to-digital converter that converts sensing signals by at least one of the first driving to the fourth driving into first to fourth digital data; and a compensation circuit that controls the reference voltage to be applied to the sensing line corresponding to the at least one line pixel, controls the first reference data to be applied to the at least one line pixel, controls the pixel current with the same value to be applied to the sensing lines, controls the second reference data to be applied to the pixels, and corrects characteristics of the sensing circuit, a characteristic deviation of the at least one line pixel, a deviation between current sensing paths of the sensing circuit, and a characteristic deviation between the pixels by using the first to fourth digital data received from the analog-to-digital converter.

11. The display device of claim 10, wherein the at least one line pixel of the display panel includes at least one of effective line pixels and dummy line pixels of the display panel.

12. The display device of claim 10, further comprising:

a reference voltage providing unit that provides the reference voltage to the sensing line corresponding to the at least one line pixel through common routing.

13. The display device of claim 12, wherein the reference voltage is a common voltage having a predetermined level.

14. The display device of claim 10, wherein, in the sensing circuit, channels corresponding to sensing lines of the display panel are formed, and each of the channels comprises:

a current-to-voltage converter that converts a signal of a corresponding sensing line into a voltage;

a sample and hold circuit that samples and holds an output voltage of the current-to-voltage converter; and a switch that directly transfers the signal of the sensing line to the sample and hold circuit.

15. The display device of claim 14, wherein the switch is turned on in the first driving and the second driving and is turned off in the third driving and the fourth driving.

16. The display device of claim 10, wherein the first reference data is data in which the characteristics of the sensing circuit have been corrected, and the second reference data is data in which the deviation between the current sensing paths of the sensing circuit has been corrected.

17. A display device comprising:

a panel compensation circuit, wherein the panel compensation circuit corrects characteristics of a source driver by applying a reference voltage to a sensing line corresponding to at least one line pixel of a display panel, corrects a characteristic deviation of the at least one line pixel by applying first reference data, in which the characteristics of the source driver have been corrected, to the at least one line pixel, corrects a deviation between current sensing paths of the source driver by applying a pixel current with a same value of the at least one line pixel to the sensing lines, and corrects a characteristic deviation between pixels by applying second reference data, in which the deviation between the current sensing paths of the source driver has been corrected, to the pixels.

18. The display device of claim 17, wherein the panel compensation circuit is included in at least one of a timing controller and the source driver.

* * * * *